US008238595B2

(12) United States Patent
Horowitz et al.

(10) Patent No.: US 8,238,595 B2
(45) Date of Patent: Aug. 7, 2012

(54) SPEAKER COMPONENT FOR A PORTABLE ELECTRONIC DEVICE

(75) Inventors: Ronald Jeffrey Horowitz, Vallejo, CA (US); Michael Francisco, Fremont, CA (US); Giancarlo Anthony Giustina, San Francisco, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 769 days.

(21) Appl. No.: 12/350,203

(22) Filed: Jan. 7, 2009

(65) Prior Publication Data

US 2010/0172530 A1 Jul. 8, 2010

(51) Int. Cl.
*H04R 1/02* (2006.01)

(52) U.S. Cl. ..... 381/345; 381/350; 381/351

(58) Field of Classification Search ..... 381/350, 381/345, 351; 181/148, 199
See application file for complete search history.

(56) References Cited

U.S. PATENT DOCUMENTS 5,092,424 A * 3/1992 Schreiber et al. ..... 181/145
5,714,721 A * 2/1998 Gawronski et al. ..... 181/156
6,002,949 A * 12/1999 Hawker et al. ..... 455/569.1
7,233,678 B2 * 6/2007 Erixon et al. ..... 381/345
7,416,048 B2 * 8/2008 Hongo et al. ..... 181/199
7,450,976 B2 * 11/2008 Hoshijima ..... 455/575.1
7,463,746 B2 * 12/2008 Caron et al. ..... 381/345
7,796,773 B2 * 9/2010 Klein ..... 381/351
2001/0017923 A1 * 8/2001 Suzuki ..... 381/150
2002/0052216 A1 * 5/2002 Song ..... 455/550
2004/0238268 A1 * 12/2004 Danley et al. ..... 181/199
2005/0181841 A1 * 8/2005 Dou ..... 455/575.1
2007/0177742 A1 * 8/2007 Edgren et al. ..... 381/89
2008/0219490 A1 * 9/2008 Yang et al. ..... 381/351

* cited by examiner

*Primary Examiner* — Jeremy Luks

(57) ABSTRACT

A speaker component for a portable electronic device which accepts a receiver and redirects the sound emitted from the receiver toward the speaker hole in the device housing is disclosed. The receiver may be oriented such that sound is directed away from the speaker hole to reduce the footprint of the receiver within the device housing. A channel of the speaker component may redirect or port the sound to the speaker hole. Accordingly, embodiments provide more flexibility for positioning of the speaker hole and the receiver with respect to the device housing. The speaker component may also have a self-contained back volume chamber adjoining the receiver which does not include portions of the device housing or other components of the portable electronic device, thereby improving the sound quality of the sound emitted from the receiver and providing more flexibility as to the size and shape of the back volume chamber.

14 Claims, 8 Drawing Sheets

100

400

500

SPEAKER COMPONENT FOR A PORTABLE ELECTRONIC DEVICE

BACKGROUND OF THE INVENTION

Receivers are small speakers used by many conventional portable electronic devices to produce sound. For example, the voice of a caller may be generated by a receiver of a conventional mobile phone. The receivers are attached to the device housing around the area in the device housing with the speaker hole. In this manner, receivers of conventional portable electronic devices project sound directly out of the speaker hole for listening by a user.

Given that the receivers are located behind the speaker hole of the device housing, the placement of the speaker holes for conventional portable electronic devices is constrained by the size and shape of the receiver. For example, the receiver is often pushed to the top of the device housing to make room for other components. As such, the speaker holes of many conventional portable electronic devices are located near the top of the device housing.

Conventional portable electronic devices with speaker holes located near the top of the device housing are generally uncomfortable to use given that the top edge of the device housing must be pressed into the user's ear. Additionally, the small distance between the speaker hole and the top of the device housing makes it more difficult for a user's ear to seal against the device housing around the speaker hole. As such, conventional portable electronic devices generally offer poor sound quality.

Back volume chambers are sometimes used in portable electronic devices to increase the sound quality of the receivers. The quality of the seal as well as the size and shape of the back volume chamber can affect the frequency bandwidth of the sound generated by the receiver. The back volume chambers of some conventional portable electronic devices are formed using sealant between walls of the device housing and other components (e.g., printed circuit boards). However, the seal created by the sealant often fails over time due to degradation of the sealant, relative movement between the printed circuit boards and the device housing, and the like. Additionally, the size and shape of the back volume chamber of conventional portable electronic devices is determined by the arrangement of the device housing and other components (e.g., printed circuit boards). Accordingly, the back volume chambers of conventional portable electronic devices offer limited improvement in sound quality.

SUMMARY OF THE INVENTION

Accordingly, a need exists for a receiver mounting for a portable electronic device which enables the speaker hole to be located farther from the top of edge of the portable electronic device housing. A need also exists for a receiver mounting which provides more flexibility on the location of the receiver within the portable electronic device housing. Additionally, a need exists for a receiver mounting which provides a more airtight back volume chamber for a receiver of a portable electronic device. Further, a need exists for a receiver mounting which provides more flexibility as to the size and shape of the back volume chamber for the receiver. Embodiments of the present invention provide novel solutions to these needs and others as described below.

Embodiments are directed to a speaker component for a portable electronic device which accepts a receiver and redirects the sound emitted from the receiver toward the speaker hole in the device housing. For example, the receiver may be oriented such that sound is directed away from the speaker hole to reduce the footprint of the receiver within the device housing, while a channel of the speaker component may redirect or port the sound to the speaker hole. In this manner, embodiments provide more flexibility for positioning of the speaker hole and the receiver with respect to the device housing. The speaker component may also have a self-contained back volume chamber adjoining the receiver which does not include portions of the device housing or other components of the portable electronic device, thereby improving the sound quality of the sound emitted from the receiver and providing more design flexibility as to the size and shape of the back volume chamber.

In one embodiment, a speaker component includes a receiver for generating sound in a first direction, the receiver for use in a portable electronic device. The speaker component also includes a channel disposed adjacent to the receiver, the channel for redirecting the sound in a second direction, wherein the first and second directions are different. The speaker component may further include a sealed chamber adjoining the receiver, the sealed chamber forming a back volume for the receiver. The speaker component may further include a first portion comprising a first cavity for accepting the receiver, the first portion further comprising the channel connected to the first cavity for enabling the sound to travel from the first cavity through the channel, a second portion comprising a second cavity, and an interstitial layer for physically coupling the first portion with the second portion, the interstitial layer further for creating a back volume for the receiver comprising the second cavity.

In another embodiment, a portable electronic device Includes a housing comprising a hole for emitting sound, a processor disposed within the housing, and a memory coupled to the processor and disposed within the housing. The portable electronic device also includes a speaker component operable to direct sound through the hole, the speaker component including a receiver for generating sound in a first direction and a channel disposed between the receiver and the hole, the channel for redirecting the sound in a second direction toward the hole, wherein the first and second directions are different.

In yet another embodiment, a portable electronic device includes a housing comprising a hole for emitting sound, a processor disposed within the housing, a memory coupled to the processor and disposed within the housing, and a display coupled with the housing. The portable electronic device also includes a speaker component operable to direct sound through the hole. The speaker component includes a receiver for generating sound in a first direction and a channel disposed between the receiver and the hole, the channel for redirecting the sound in a second direction toward the hole, wherein the first and second directions are approximately orthogonal. The speaker component also includes a seated chamber adjoining the receiver and forming a back volume for the receiver.

BRIEF DESCRIPTION OF THE DRAWINGS

The present invention is illustrated by way of example, and not by way of limitation, in the figures of the accompanying drawings and in which like reference numerals refer to similar elements.

DETAILED DESCRIPTION OF THE INVENTION

Reference will now be made In detail to embodiments of the present invention, examples of which are illustrated in the accompanying drawings. While the present invention will be discussed in conjunction with the following embodiments, it will be understood that they are not intended to limit the present invention to these embodiments alone. On the contrary, the present invention is intended to cover alternatives, modifications, and equivalents which may be included with the spirit and scope of the present invention as defined by the appended claims. Furthermore, in the following detailed description of the present invention, numerous specific details are set forth in order to provide a thorough understanding of the present invention. However, embodiments of the present invention may be practiced without these specific details. In other instances, well-known methods, procedures, components, and circuits have not been described in detail so as not to unnecessarily obscure aspects of the present invention.

Figure 3:
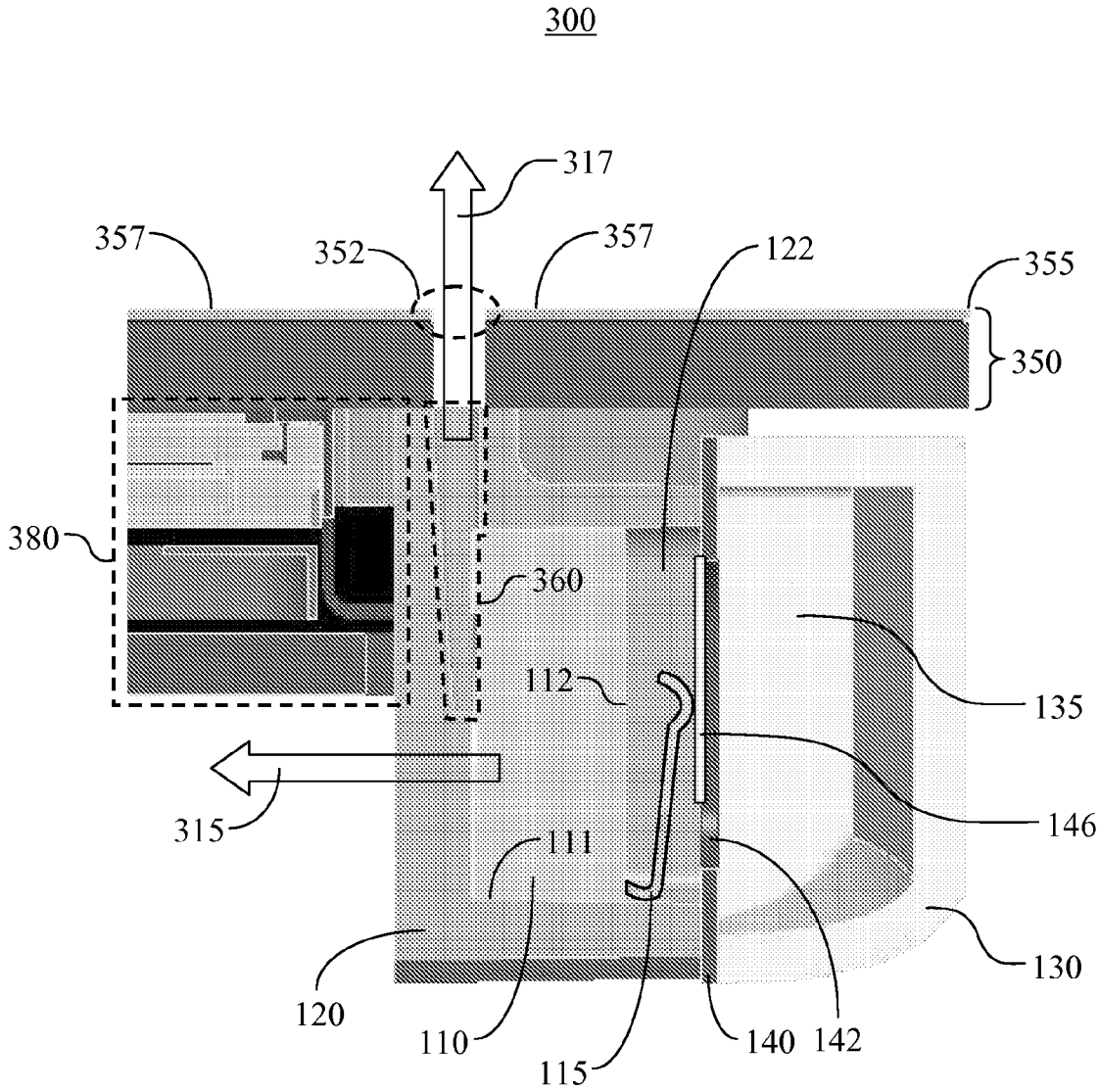
FIG. 3 shows a cross-sectional view of a speaker component within an exemplary portable electronic device in accordance with one embodiment of the present invention.
Figure 4:
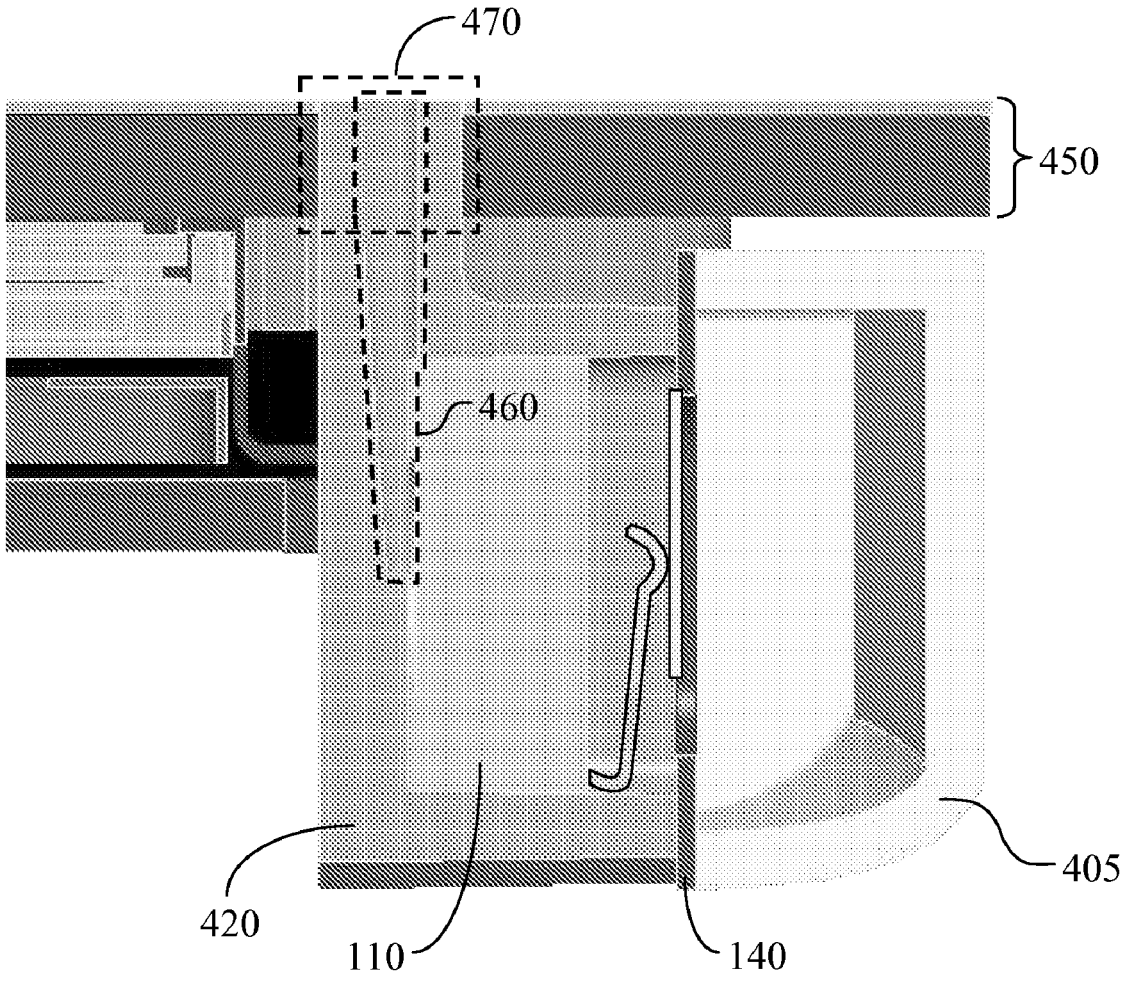
FIG. 4 shows an exemplary portable electronic device with an exemplary speaker component utilizing an elongated channel in accordance with one embodiment of the present invention.
Figure 5:
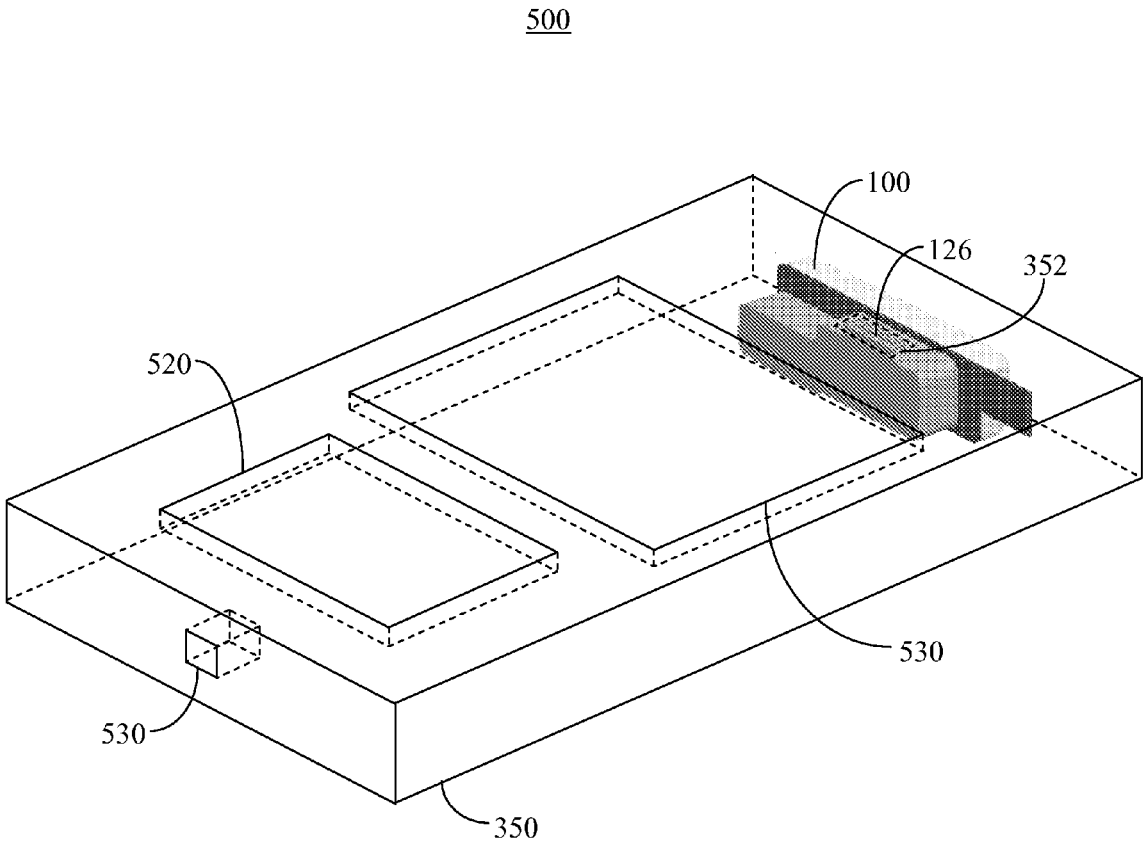
FIG. 5 shows an exemplary portable electronic device with exemplary interface components in accordance with one embodiment of the present invention.
Figure 6:
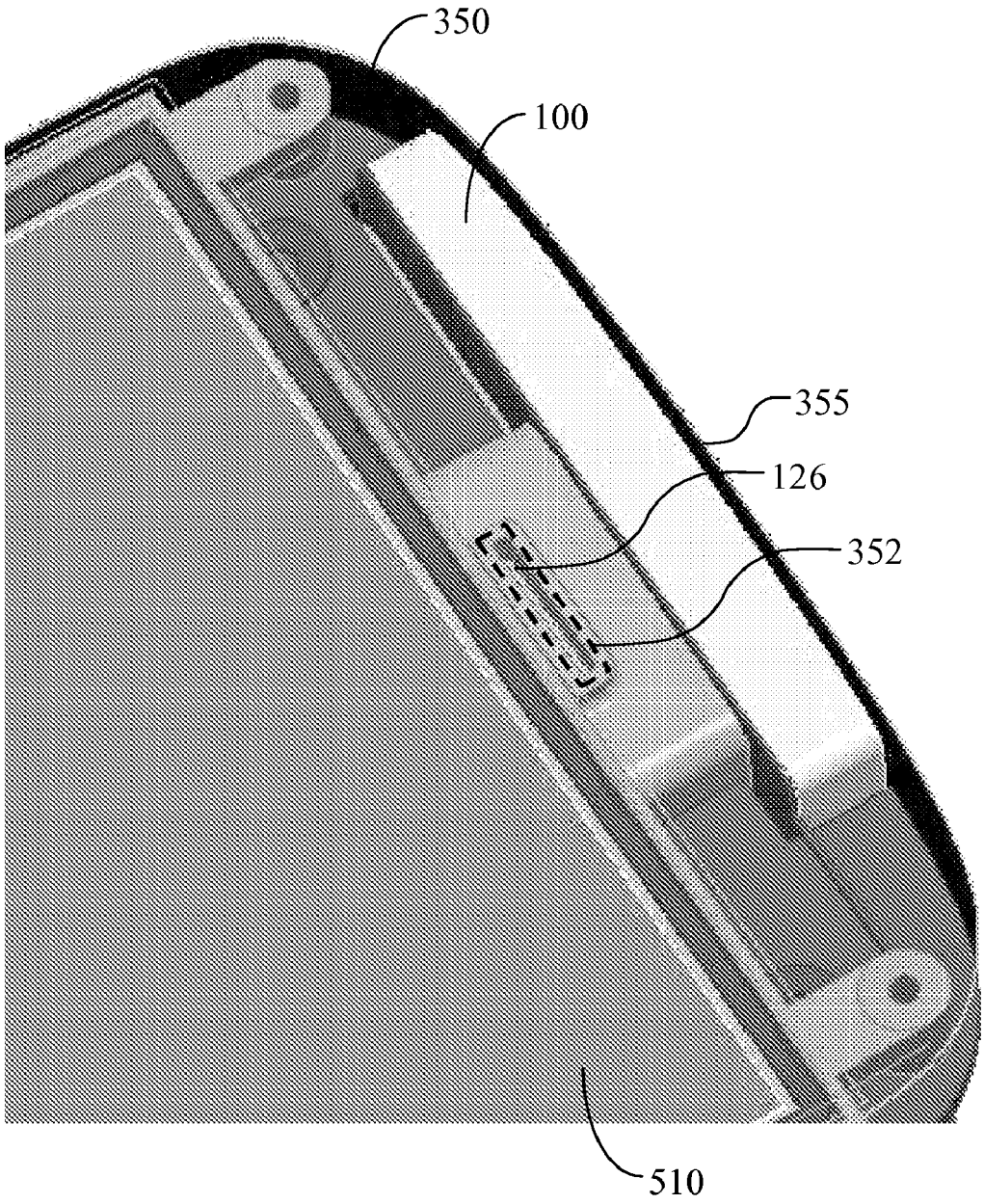
FIG. 6 shows an exemplary portable electronic device with a speaker hole located relatively close to other components of the portable electronic device in accordance with one embodiment of the present invention.

Embodiments of the present invention are directed to a speaker component or assembly (e.g., 100 of FIG. 1A, FIG. 1B, etc.) for a portable electronic device which accepts a receiver (e.g., receiver 110 of FIG. 1A, FIG. 1B, FIG. 3 and FIG. 4) and redirects the sound emitted from the receiver toward the speaker hole (e.g., hole 352 of FIG. 3, FIG. 4 and FIG. 8) in the device housing (e.g., device housing 350 of FIG. 3, FIG. 5 and FIG. 6). For example, the receiver may be oriented such that sound is directed away from the speaker hole (e.g., in a direction other than directly towards the speaker hole such as the direction indicated by arrow 315 of FIG. 3) to reduce the footprint of the receiver within the device housing, while a channel (e.g., channel 360 of FIG. 3 and/or channel 460 of FIG. 4) of the speaker component may redirect or port the sound to the speaker hole. In this manner, embodiments provide more flexibility for positioning of the speaker hole on the device housing and for positioning of the receiver within the device housing.

The speaker component or assembly may also have a self-contained back volume chamber adjoining the receiver which does not include portions of the device housing or other components of the portable electronic device. For example, a cavity (e.g., cavity 135, cavity 124, etc.) within a portion of the speaker component (e.g., portion 130, portion 120, etc.) may adjoin the receiver and provide a sealed back volume chamber for the receiver. Accordingly, embodiments may improve the sound quality of the sound emitted from the receiver and offer more design flexibility (e.g., mechanical design flexibility, industrial design flexibility, etc.) since features of the back volume chamber (e.g., size, shape, location with respect to the receiver, etc.) may be varied independently of the housing and other components of the portable electronic device (e.g., since the back volume chamber of the speaker component is self-contained and therefore does not include portions of the device housing or other components of the portable electronic device).

The term "portable electronic device" as used herein may refer to any electronic device capable of being moved or transported by a user. For example, a portable electronic device may be a portable computer system (e.g., a laptop, portable general-purpose computer system, etc.), a mobile phone, a portable digital assistant (PDA), a digital music player, a digital video player, a portable gaming system, other portable devices, some combination thereof, etc.

Figure 1A:
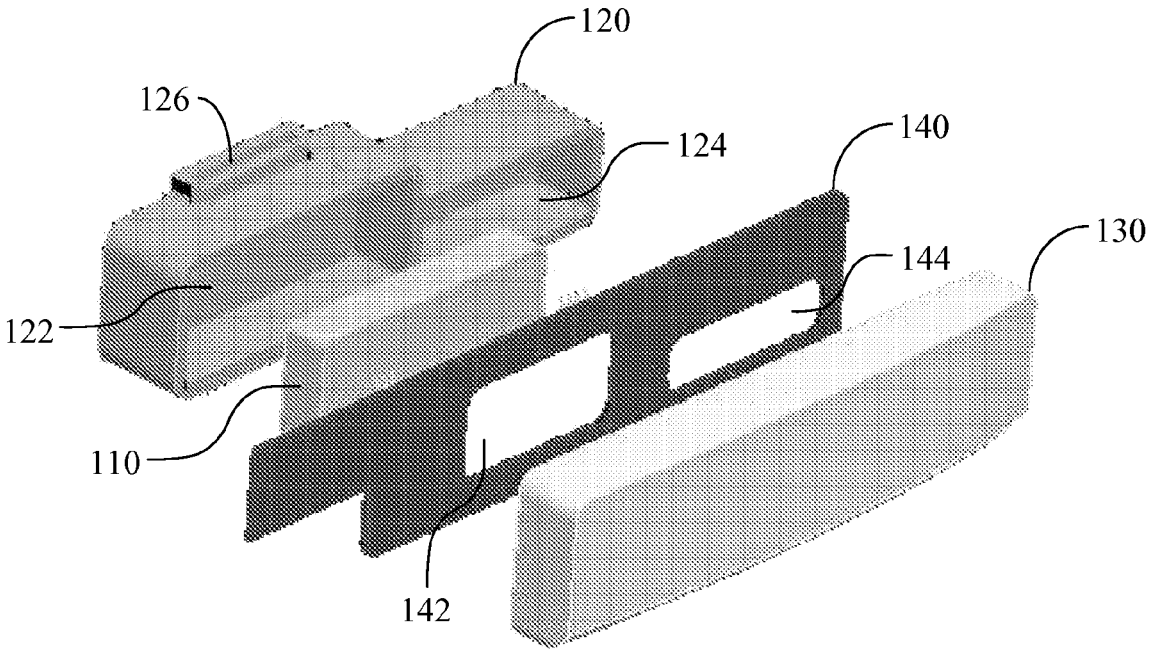
FIG. 1A shows a first exploded view of an exemplary speaker component in accordance with one embodiment of the present invention.
Figure 1B:
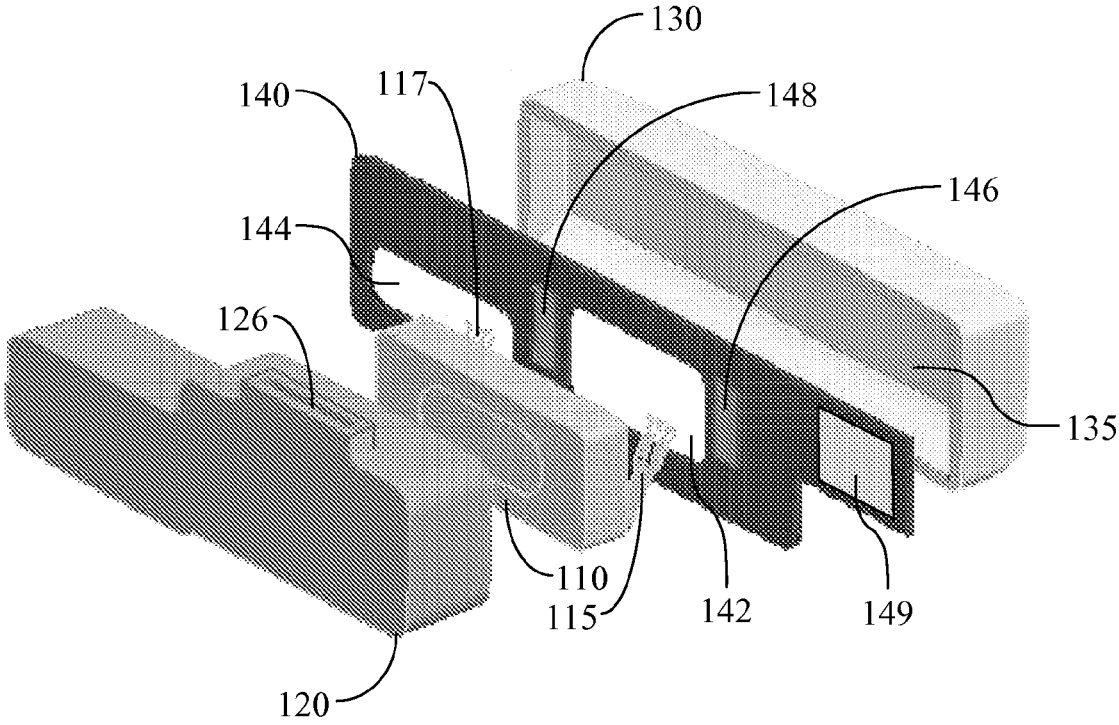
FIG. 1B shows a second exploded view of an exemplary speaker component in accordance with one embodiment of the present invention.
Figure 2:
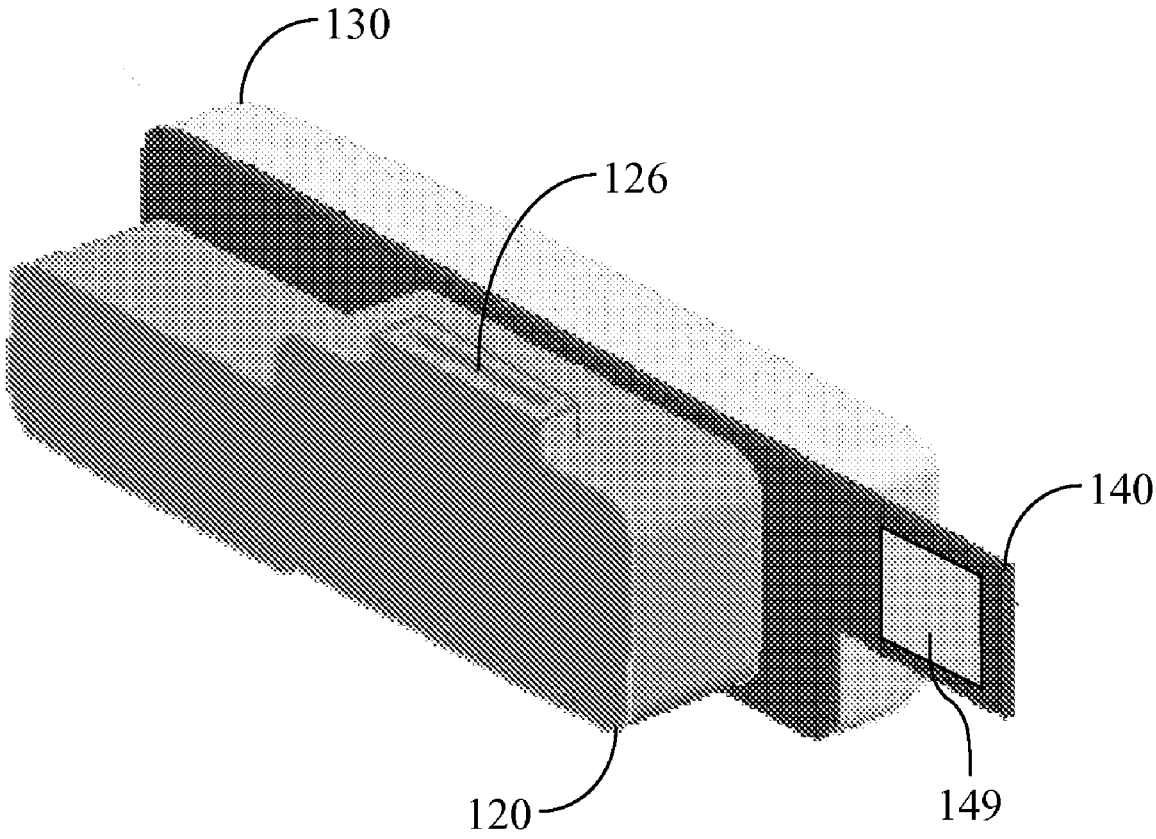
FIG. 2 shows an assembled view of an exemplary speaker component in accordance with one embodiment of the present invention.

FIG. 1A and FIG. 1B show exploded views of exemplary speaker component 100 in accordance with one embodiment of the present invention, while FIG. 2 shows an assembled view of exemplary speaker component 100 in accordance with one embodiment of the present invention. FIG. 3 shows a cross-sectional view of speaker component 100 within exemplary portable electronic device 300 in accordance with one embodiment of the present invention.

As shown in FIG. 2, speaker component 100 may include first portion 120 and second portion 130, where first portion 120 is coupled with second portion 130 via interstitial layer 140. Receiver 110 may be placed within cavity 122 (e.g., as shown in FIG. 1A and FIG. 3) before coupling the components (e.g., first portion 120, second portion 130 and interstitial layer 140) of speaker component 100 to one another. In this manner, sound emitted in a first direction (e.g., as indicated by arrow 315 of FIG. 3) by receiver 110 may be redirected in a second direction (e.g., as indicated by arrow 317 of FIG. 3) by channel 360. The sound may exit channel 360 through hole 126 in first portion 120. Additionally, when hole 128 of speaker component 100 is brought into proximity or aligned with a speaker hole (e.g., 352) in the device housing (e.g., 350) of a portable electronic device (e.g., 300), channel 360 may direct sound through the speaker hole (e.g., 352) for listening by a user.

In one embodiment, a seal may be created between first portion 120 (e.g., around hole 126) and device housing 350. For example, sealant, adhesive, a gasket, or the like, may be disposed between first portion 120 and device housing 350. Since sound from receiver 110 propagated through device housing 350 may interfere with the operation of other components of portable electronic device 300 (e.g., a microphone disposed within device housing 350), embodiments may improve the operation of portable electronic device 300 by reducing the amount of sound from receiver 110 propagated through device housing 350.

By reorienting receiver 100 and redirecting the sound emitted from receiver 100 (e.g., using channel 360), embodiments provide design flexibility related to the mechanical design (e.g., how components and/or features of the portable electronic device are laid out or configured) and/or industrial design (e.g., how the components and/or features of the portable electronic device look). For example, by placing receiver 100 on its short or smaller dimension (e.g., dimension 111 as compared to larger dimension 112), embodiments reduce the footprint of receiver 110 and enable speaker hole 352 to be placed relatively close to other components (e.g., 380) of the portable electronic device (e.g., 300). Accordingly, embodiments enable speaker hole 352 to be located further from device housing edge 355, thereby making the portable electronic device more comfortable to use (e.g., by enabling a user's ear to rest against surface 357 of device housing 350 instead of edge 355) and improving the quality of the sound emitted from the portable electronic device (e.g., by improving the seal between a user's ear and device housing 350 around speaker hole 352).

Although FIGS. 1A, 1B, 2 and 3 show components of speaker component 100 (e.g., receiver 110, first portion 120, second portion 130, interstitial layer 140, channel 360, etc.) with specific sizes, shapes, positions, orientations, etc., it should be appreciated that components of speaker component 100 (e.g., receiver 110, first portion 120, second portion 130, interstitial layer 140, channel 360, etc.) may have alternative sizes, shapes, positions, orientations, etc. For example, channel 360 may be elongated such that receiver 110 may be positioned closer to edge 355 while speaker hole 352 remains in essentially the same position in device housing 350. As another example, receiver 110 may be placed at an alternative angle (e.g., a 45 degree angle with respect to the orientation shown in FIG. 3, on its longer dimension 112, in another orientation and position such that the sound generated from receiver 110 is not directly emitted from speaker hole 352, etc.) and channel 360 may be alternatively shaped and/or sized to direct the sound emitted from receiver 110 to speaker hole 352.

In one embodiment, speaker component 100 may utilize a sealed back volume chamber to improve the sound quality of receiver 110. For example, cavity 135 of second portion 130 may be joined with cavity 122 of first portion 120 (e.g., via hole 142 in interstitial layer 140), thereby forming a back volume chamber including cavity 135 and a portion of cavity 122 behind receiver 110. Additionally, receiver 110 may be sealed (e.g., by sealant, adhesive, a gasket, etc.) within cavity 122 of first portion 120 to reduce the ability for air to flow around receiver 110 (e.g., from channel 360 toward interstitial layer 140 and vice versa). Accordingly, the back volume chamber may be sealed or airtight with respect to ambient air (e.g., within channel 360, outside of speaker component 100, outside of device housing 350, etc.).

In one embodiment, hole 144 in interstitial layer may be used to join cavity 124 of first portion 120 to cavity 135 of second portion 130. Accordingly, the sealed back volume chamber may include cavity 124, cavity 135 and a portion of cavity 122 behind receiver 110.

Thus, embodiments provide design flexibility related to the size of back volume chamber of speaker component 100. For example, the size of the back volume chamber may be increased by increasing the number of cavities of the first portion 110 and/or second portion 130, by increasing the size of the cavities which form the back volume chamber, by adding holes in interstitial layer 140 to join additional cavities to the back volume chamber, some combination thereof, etc. Alternatively, the size of the back volume chamber may be decreased by reducing the number of cavities of the first portion 110 and/or second portion 130, by decreasing the size of the cavities which form the back volume chamber, by removing or blocking off holes in interstitial layer 140 to seal offer separate one or more cavities from the back volume chamber, some combination thereof, etc.

Further, embodiments provide design flexibility related to the shape of back volume chamber of speaker component 100. For example, in one embodiment, cavity 124 can be omitted from first portion 120 to make room for other components of the portable electronic device (e.g., 300). Alternatively, cavities may be added to speaker component 100 to fill unused space within the device housing (e.g., 350) of the portable electronic device (e.g., 300). In this manner, embodiments provide further design flexibility.

As shown in FIG. 1B, receiver 110 may include members 115 and 117 for interfacing with electrical contacts 148 and 148, respectively, of interstitial layer 140. Members 115 and 117 may electrically couple to components of the receiver (e.g., mechanical and electrical components used to transform electrical signals into sound). Additionally, electrical contacts 146 and 148 may be coupled to electrical contacts 149, where electrical contacts 149 may include a plurality of contacts with at least one contact coupled to electrical contact 146 and at least one contact coupled to electrical contact 148. In this manner, receiver 110 may be electrically coupled to other components of the portable electronic device (e.g., 300) when sealed within speaker component 100 (e.g., when speaker component 100 is in an assembled state as shown in FIGS. 2 and 3).

In one embodiment, interstitial layer 140 may be a printed circuit board (PCB) with at least one layer. The electrical contacts (e.g., 146, 148 and 149) and/or any electrical interconnections between the electrical contacts (e.g., traces of the PCB) may be formed as part of the interstitial layer 140 (e.g., formed from at least one layer of the PCB) and/or mechanically coupled to the PCB (e.g., soldered onto the PCB, etc.).

Members 115 and 117 may be used to hold receiver 110 within cavity 122 of first portion 120 when speaker component 100 is in an assembled state (e.g., as shown in FIGS. 2 and 3). For example, members 115 and 117 may press against a respective electrical contact (e.g., 148 and 148) of interstitial layer 140. Additionally, members 115 and 117 may bend and deflect when speaker component 100 is in an assembled state, thereby applying a force (e.g., similar to a spring) to receiver 110 and securing it within cavity 122 of first portion 120. As such, in one embodiment, members 115 and 117 may be used to mechanically secure receiver 110 within speaker component 110 and also be used to provide electrical access to receiver 110 when sealed within speaker component 110 (e.g., when speaker component 100 is in an assembled state as shown in FIGS. 2 and 3).

In one embodiment, first portion 120 may be directly coupled to second portion 130, thereby omitting interstitial layer 140. Receiver 110 may be secured within cavity 122 by adhesive, sealant, or the like. The sealed back volume chamber may include cavity 135, cavity 124, a portion of cavity 122 behind receiver 110, or some combination thereof. The size and/or shape of the sealed back volume chamber may be changed by adding features to first portion 120 and/or second portion 130. For example, a portion of cavity 135 may be filled to seal off or separate cavity 124 from the back volume chamber. Further, electrical access to receiver 110 may be implemented by running wires from receiver 110 outside speaker component 100, where the area around the wires may be sealed to maintain or create the seal of the back volume chamber with respect to the ambient air.

FIG. 4 shows exemplary portable electronic device 400 with exemplary speaker component 405 utilizing elongated channel 480 in accordance with one embodiment of the present invention. As shown in FIG. 4, exemplary speaker component 405 is similar to speaker component 100 (e.g., both include receiver 110, second portion 130 and interstitial layer 140) except that speaker component 405 includes first portion 420 instead of first portion 120 of speaker component 100. First portion 420 includes elongated channel 480 which is longer than channel 380 of speaker component 100. In this manner, "snorkel tip" or portion 470 of first portion 420 may extend through device housing 450 of portable electronic device 400.

In one embodiment, portion 470 may provide an increased surface area for sealing first portion 420 to device housing 450. For example, sealant, adhesive, a gasket, or the like, may be disposed between first portion 420 and device housing 450. Since sound from receiver 110 propagated through device housing 450 may interfere with the operation of other components of portable electronic device 300 (e.g., a microphone disposed within device housing 450), embodiments may improve the operation of portable electronic device 400 by further reducing the amount of sound from receiver 110 propagated through device housing 450.

FIG. 5 shows exemplary portable electronic device 500 with exemplary interface components in accordance with one embodiment of the present invention. In one embodiment, exemplary portable electronic device 500 may operate analogously to portable electronic device 300 and/or portable electronic device 400.

As shown in FIG. 5, portable electronic device 500 includes speaker component 352 positioned so that sound emitted from hole 126 is directed out of speaker hole 352 in device housing 350. Portable electronic device 500 also includes a plurality of other components (e.g., display device 510, input component 520 and microphone 530) disposed at least partially within device housing 350. Portable electronic device 500 may also include other components (e.g., a processor, memory, other components of portable electronic device 700, etc.) disposed at least partially within device housing 350.

Display device 510 may be any device capable of displaying an image. For example, display device 510 may include a liquid crystal display (LCD), a light-emitting diode (LED) display, a organic light-emitting diode (OLED) display, a plasma display, or the like. In one embodiment, display device 510 may be a cathode ray tube (CRT) display.

Input component 520 may be any device for accepting a user input which may be communicated to other components of the portable electronic device (e.g., 500) for further processing. For example, input component 520 may include at least one physical key or button which may be physically depressed by a user. Alternatively, input component 520 may comprise a touch screen disposed over display device 510, thereby enabling a user to interact with displayed graphical objects (e.g., buttons, images, etc.).

Microphone 530 may be any device operable to transform sound into a signal for processing by other components of the portable electronic device (e.g., 500). For example, microphone 500 may be a piezoelectric microphone, a capacitor microphone, an electret microphone, a dynamic microphone or another type of microphone.

Although portable electronic device 500 includes speaker component 100 as shown in FIG. 5, it should be appreciated that other speaker components may be used in other embodiments. For example, portable electronic device 500 may include speaker component 405 (e.g., of FIG. 4) instead of speaker component 100.

FIG. 8 shows exemplary portable electronic device 500 with speaker hole 352 located relatively close to other components of portable electronic device 500 in accordance with one embodiment of the present invention. Since hole 126 is located near the edge of speaker component 100 (e.g., given the reorientation of receiver 110 and the use of channel 380 to redirect sound emitted from receiver 110 as discussed herein), hole 128 may also be located relatively close to display device 510 as shown in FIG. 6.

Speaker hole 352 may be substantially aligned or otherwise in proximity to hole 126, and therefore, speaker hole 352 may also be located relatively close to display device 510 as shown in FIG. 6. In this manner, embodiments enable speaker hole 352 to be moved further from the edge 355 of device housing 350, thereby making the portable electronic device (e.g., 500) more comfortable to use (e.g., by enabling a user's ear to rest against the top surface of device housing 350 instead of edge 355) and improving the quality of the sound emitted from the portable electronic device (e.g., by improving the seal between a user's ear and device housing 350 around speaker hole 352).

Figure 7:
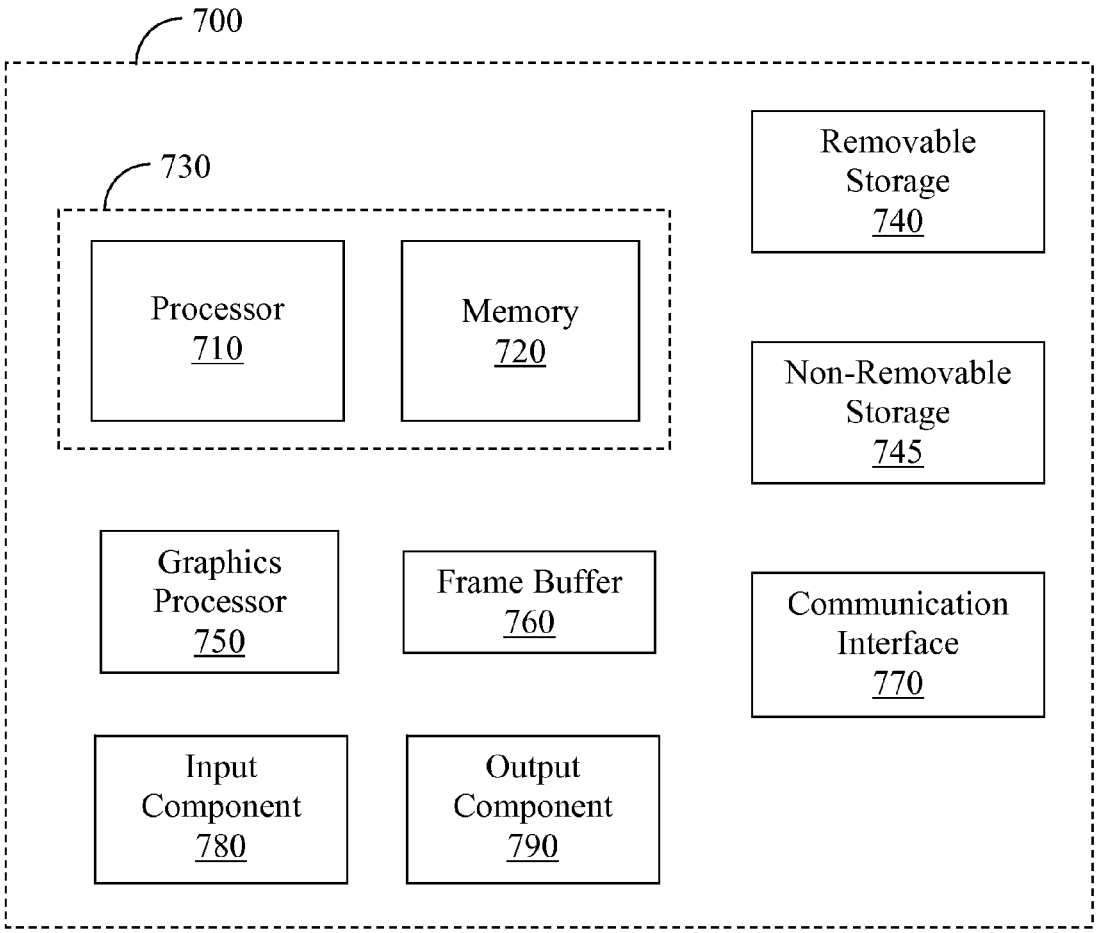
FIG. 7 shows an exemplary computer system platform upon which embodiments of the present invention may be implemented.

FIG. 7 shows exemplary computer system platform 700 upon which embodiments of the present invention may be implemented. For example, computer system 700 may be used to implement portable electronic device 300, portable electronic device 400, portable electronic device 500, or some combination thereof. As shown in FIG. 7, portions of the present invention are comprised of computer-readable and computer-executable instructions that reside, for example, in computer system platform 700 and which may be used as a part of a general purpose computer network (not shown). It is appreciated that computer system platform 700 of FIG. 7 is merely exemplary. As such, the present invention can operate within a number of different systems including, but not limited to, general-purpose computer systems, embedded computer systems, laptop computer systems, hand-held computer systems, portable computer systems, stand-alone computer systems, portable electronic devices, game consoles, gaming systems or machines (e.g., found in a casino or other gaming establishment), or online gaming systems.

In one embodiment, depicted by dashed fines 730, computer system platform 700 may comprise at least one processor 710 and at least one memory 720. Processor 710 may comprise a central processing unit (CPU) or other type of processor. Depending on the configuration and/or type of computer system environment, memory 720 may comprise volatile memory (e.g., RAM), non-volatile memory (e.g., ROM, flash memory, etc.), or some combination of the two. Additionally, memory 720 may be removable, non-removable, etc.

In other embodiments, computer system platform 700 may comprise additional storage (e.g., removable storage 740, non-removable storage 745, etc.). Removable storage 740 and/or non-removable storage 745 may comprise volatile memory, non-volatile memory, or any combination thereof. Additionally, removable storage 740 and/or non-removable storage 745 may comprise CD-ROM, digital versatile disks (DVD) or other optical storage, magnetic cassettes, magnetic tape, magnetic disk storage or other magnetic storage devices, or any other medium which can be used to store information for access by computer system platform 700.

As shown in FIG. 7, computer system platform 700 may communicate with other systems, components, or devices via communication interface 770. Communication interface 770 may embody computer readable instructions, data structures, program modules or other data in a modulated data signal (e.g., a carrier wave) or other transport mechanism. By way of example, and not limitation, communication interface 770 may couple to wired media (e.g., a wired network, direct-wired connection, etc.) and/or wireless media (e.g., a wireless network, a wireless connection utilizing acoustic, RF, infrared, or other wireless signaling, etc.).

Input component 780 may include any component for enabling a user, system, etc. to provide an input to system 700. For example, input component 780 may include a keyboard, mouse, pen, voice input device (e.g., microphone), touch input device (e.g., touchscreen), visual input device (e.g., optical sensor, etc.), some combination thereof, etc.

As shown in FIG. 7, output component 790 may include any component for enabling system 700 to provide an output to a user, system, etc. For example, output component 790 may include a display device (e.g., LCD, LED, OLED, plasma, CRT, etc.), speaker, printer, some combination thereof, etc.

Graphics processor 750 may perform graphics processing operations on graphical data stored in frame buffer 760 or another memory (e.g., 720, 740, 745, etc.) of computer system platform 700. Graphical data stored in frame buffer 760 may be accessed, processed, and/or modified by components (e.g., graphics processor 750, processor 710, etc.) of computer system platform 700 and/or components of other systems/devices. Additionally, the graphical data may be accessed (e.g., by graphics processor 750) and displayed on an output device coupled to computer system platform 700. Accordingly, memory 720, removable storage 740, non-removable storage 745, frame buffer 760, or a combination thereof, may comprise instructions for execution on a processor (e.g., 710, 750, etc.).

In the foregoing specification, embodiments of the invention have been described with reference to numerous specific details that may vary from implementation to implementation. Thus, the sole and exclusive indicator of what is, and is intended by the applicant to be, the invention is the set of claims that issue from this application, in the specific form in which such claims issue, including any subsequent correction. Hence, no limitation, element, property, feature, advantage, or attribute that is not expressly recited in a claim should limit the scope of such claim in any way. Accordingly, the specification and drawings are to be regarded in an illustrative rather than a restrictive sense.

What is claimed is:

1. A portable electronic device comprising:

a housing comprising a hole for emitting sound;

a processor disposed within said housing;

a memory coupled to said processor and disposed within said housing; and a speaker component operable to direct sound through said hole, said speaker component comprising:

a receiver for generating sound in a first direction;

a channel disposed between said receiver and said hole, said channel for redirecting said sound in a second direction toward said hole, wherein said first and second directions are different;

a first portion comprising a first cavity for accepting said receiver, a second portion comprising a second cavity; and an interstitial layer disposed between the first and second portions, the interstitial layer creating a back volume for said receiver, the back volume comprising said second cavity.

2. The portable electronic device of claim 1, wherein said first portion further comprises said channel connected to said first cavity for enabling said sound to travel from said first cavity through said hole of said housing.

3. The portable electronic device of claim 2, wherein said first portion further comprises a third cavity separate from said first cavity, and wherein said interstitial layer is further operable to create a back volume for said receiver, said back volume comprising said second cavity and said third cavity.

4. The portable electronic device of claim 2, wherein said interstitial layer further comprises circuitry for coupling said receiver to said processor.

5. The portable electronic device of claim 1, wherein said first and second directions are approximately perpendicular to one another.

6. The portable electronic device of claim 1, wherein said channel extends through said hole of said housing.

7. A portable electronic device comprising:

a housing comprising a hole for emitting sound;

a processor disposed within said housing;

a memory coupled to said processor and disposed within said housing;

a display coupled with said housing; and a speaker component operable to direct sound through said hole, said speaker component comprising:

a receiver for generating sound in a first direction;

a first portion comprising a first cavity for accepting said receiver;

a channel disposed between said receiver and said hole, said channel for redirecting said sound in a second direction toward said hole, wherein said first and second directions are approximately orthogonal; and a second portion comprising a second cavity, the second cavity adjoining said receiver and forming a back volume for said receiver.

8. The portable electronic device of claim 7, wherein said first portion further comprises said channel connected to said first cavity for enabling said sound to travel from said first cavity through said hole of said housing; and wherein an interstitial layer is disposed between said first portion and said second portion for physically coupling said first portion with said second portion.

9. The portable electronic device of claim 8, wherein said first portion further comprises a third cavity separate from said first cavity, and wherein said back volume further comprises said third cavity.

10. The portable electronic device of claim 8, wherein said interstitial layer further comprises circuitry for coupling said receiver to said processor.

11. The portable electronic device of claim 7, wherein said channel extends through said hole of said housing.

12. The portable electronic device of claim 1, wherein the interstitial layer comprises first and second electrical contacts and the receiver comprises first and second members for interfacing with the first and second electrical contacts.

13. The portable electronic device of claim 12, wherein the first and second members press against the first and second electrical contacts to apply a force to the receiver to secure the receiver within the first cavity.

14. The portable electronic device of claim 12, wherein the interstitial layer further comprises a third electrical contact for electrically coupling the receiver to other components of the portable electronic device.

* * * * *